United States Patent [19]

Brister et al.

[11] Patent Number: 4,771,944

[45] Date of Patent: Sep. 20, 1988

[54] RAIL PADS AND RAIL ASSEMBLIES INCLUDING SUCH PADS

[75] Inventors: Derek Brister, Buckden; Edward Whittome, Hartford; David Rhodes, Hitchin; Geoffrey G. Leeves, Bearsted, all of England

[73] Assignee: Pandrol Limited, London, England

[21] Appl. No.: 16,394

[22] Filed: Feb. 19, 1987

Related U.S. Application Data

[63] Continuation of Ser. No. 754,411, Jul. 12, 1985, abandoned.

[30] Foreign Application Priority Data

Jul. 13, 1984 [GB] United Kingdom ..... 8417950
Nov. 1, 1984 [GB] United Kingdom ..... 8427690

[51] Int. Cl.[4] ..... E01B 9/68
[52] U.S. Cl. ..... 238/283; 238/382
[58] Field of Search ..... 238/283, 382

[56] References Cited

U.S. PATENT DOCUMENTS 4,648,554 3/1987 McQueen ..... 238/283

FOREIGN PATENT DOCUMENTS

| | | | |
|---|---|---|---|
| 215453 | 6/1956 | Australia | 238/283 |
| 865147 | 1/1953 | Fed. Rep. of Germany | 238/283 |
| 1014139 | 1/1958 | Fed. Rep. of Germany . | |
| 211567 | 10/1959 | France | 238/283 |
| 938736 | 10/1963 | United Kingdom . | |
| 1323624 | 7/1983 | United Kingdom . | |

*Primary Examiner*—Johnny D. Cherry
*Assistant Examiner*—Joseph D. Pape
*Attorney, Agent, or Firm*—Bacon & Thomas

[57] ABSTRACT

The invention provides an elastomeric rail pad of generally rectangular plan configuration, the pad having an upper face adapted to underly the lower face of a rail, and a lower face adapted to overly a rail foundation member, wherein each of the upper and the lower faces of the pad is provided with a multiplicity of distinct and separate portions, when separately viewed from adjacent side edges of the rectangular pad, raised above the base level of the respective face and adapted to engage the rail or the foundation member respectively, the arrangement being such that between approximately 30% and 70% of that part of each face of the pad which is arranged to lie directly between the rail and the foundation member is constituted by the raised surface portions.

10 Claims, 4 Drawing Sheets

(a) Train speed = 50 m.p.h.

(b) Train speed = 100 m.p.h.

RAIL PADS AND RAIL ASSEMBLIES INCLUDING SUCH PADS

This application is a continuation of application Ser. No. 754,411, filed July 12, 1985, now abandoned.

This invention relates to rail pads. Such pads are interposed between the lower surface of a railway rail and a foundation member on which the rail stands and to which it is usually secured. The rail foundation member may be a concrete or steel sleeper extending across the railway track, or a slab or plate, for example, running along the length of the rail. The purpose of the rail pad is to protect the foundation member from impulsive and other loads from passing rail traffic, to compensate for any unevenness in the foundation member and, where the rail is electrical, to provide some electrical insulation between the rail and the foundation member.

The invention also relates to assemblies of rails, pads and rail foundation members when secured together.

It is an object of the present invention to provide a rail pad and a rail pad assembly having good impact protective characteristics with respect to the foundation member.

According to the invention there is provided an elastomeric rail pad of generally rectangular plan configuration, the pad having an upper face adapted to underly the lower face of a rail, and a lower face adapted to overly a rail foundation member, wherein each of the upper and the lower faces of the pad is provided with a multiplicity of distinct and separate surface portions, when separately viewed from adjacent side edges of the rectangular pad, raised above the base level of the respective face and adapted to engage the rail or the foundation member respectively, the arrangement being such that between approximately 30% and 70% of the part of each face of the pad which is arranged to lie directly between the rail and the foundation member is constituted by the raised surface portions.

We have found that a pad according to the invention improves the attenuation (or isolation) of the foundation member from forces exerted by the rail due to traffic passing there across, this being particularly true with respect to high frequency bending strain in the foundation member, which is of considerable practical importance.

We believe that the specified range of proportion of raised surface portion of each face is of importance. Below the specified range, heavier loading on the raised surface portions can cause pad wear problems, whilst above the specified range the dynamic attenuation characteristics of the pad are adversely affected. Preferably between approximately 40% and 60% of that part of each face of the pad which is arranged to lie directly between the rail and the foundation member is constituted by the raised surface portions.

The number and disposition of the raised surface portions can vary within the scope of the invention, but in one preferred embodiment at least 20 raised surface portions are provided per 100cm$^2$ of pad face, such portions being preferably of generally the same size, generally the same configuration, and generally evenly spaced across the face. Thus, in a typical pad having an area directly between the rail and the foundation member of approximately 190 mm by 140 mm, a minimum of approximately 50 raised surface portions will preferably be provided on each face of generally the same size and configuration, and generally evenly spaced across the face.

The pad may be at least 6mm in overall thickness and may have an overall thickness of between 7 and 15 mm, preferably between 6.5 and 12 mm.

The pad is preferably formed of a high resilient elastomer (between 30 and 90% rebound value, preferably between 55 and 75); is of high abrasion resistance; has a minimum electrical volume resistance of $1.5\times10^5$ ohms; and is between 45 and 95 shore A hardness (preferably between 60 and 90). The pads may be formed of natural rubber, or other material such as plastics or synthetic rubber having the characteristics enumerated hereinabove. The characteristics may stem from the inherent chemical nature of the material or from treatment to which it is subjected, such as chemical cross-linking.

We have found that natural rubber because its dynamic stiffness is relatively frequency insensitive, is highly suitable for the pad of the invention.

The raised surface portions of the pad may be provided by any satisfactory means, but in one embodiment are provided by a plurality of separate stud like projections upstanding from the base surface. The stud like projections may oppose each other on opposite faces so as to extend both upwardly and downwardly from a central web of elastomeric material extending across the width and length of the pad. The projections may be of any convenient cross-section and each may be of generally similar dimensions both along and across the pad. They may for example be solid cylindrical. The projections may all have the same or generally similar dimensions.

The pad may be injection moulded.

The pad may be provided with a rim thicker than the central web along part of its periphery. In particular, opposed sides of the pad adapted in use to co-operate with securing member if a rail assembly may be provided with such a thickened rim so as to provide stiffness by their increased bulk at the sides of the pad. These opposed side rims may be formed of a harder material than the remainder of the pad such that the pad overall is a composite moulding, or may be provided with metal or plastic (eg hard nylon) inserts to provide stiffness.

In the typical pad mentioned above of approximately 190 mm$\times$140 mm area between the rail and the foundation member a total of between 150 and 200 similar circular section upstanding studs may be provided, each being separate from and set apart from each other. The studs may be arranged to be equi-spaced from each other, or may be closer together in the direction which is in use at right angles to the rail, so that they provide mutual support in conditions (such as cambered railroad) where rail rocking might occur.

The invention includes within its scope a rail assembly incorporating a rail pad as herein defined.

In order that the invention may be more readily understood, one embodiment thereof will now be described by way of example with reference to the accompanying drawings in which.

Figure 1:
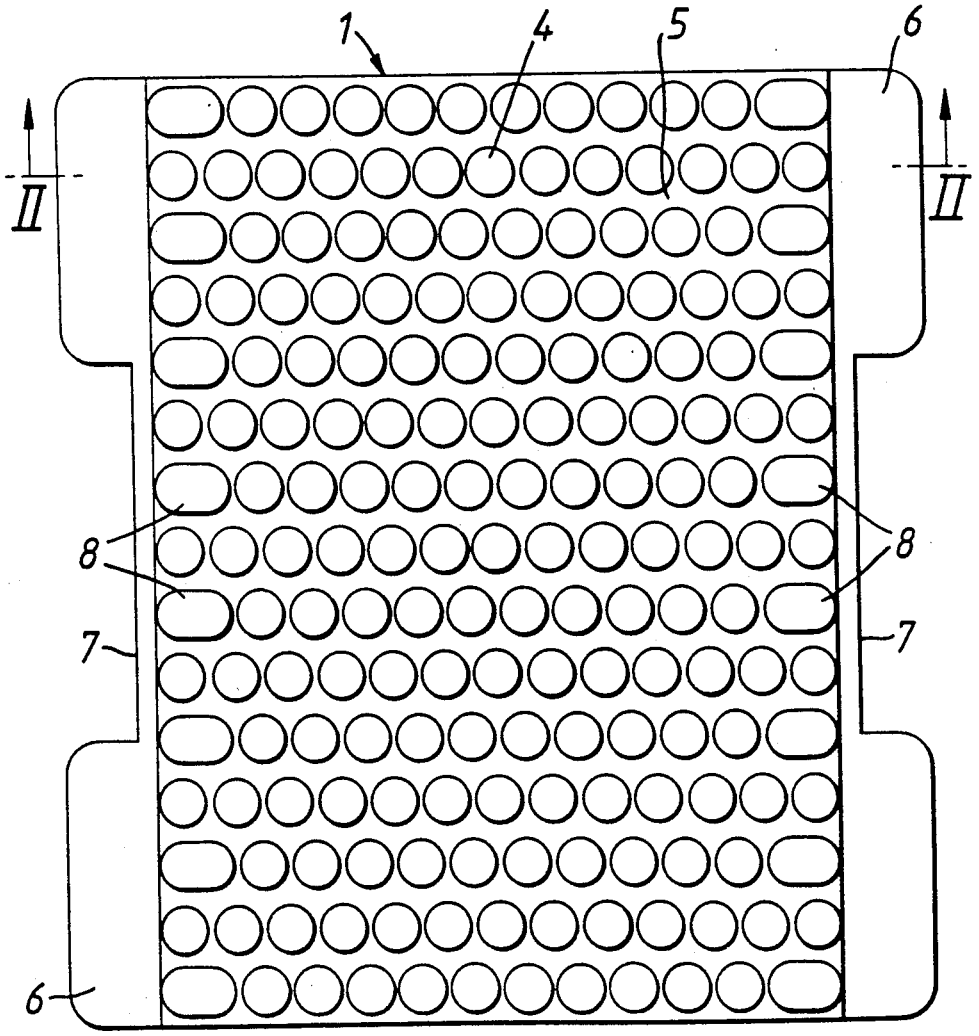
FIG. 1 is a plan view of a rail pad according to the invention.
Figure 2:
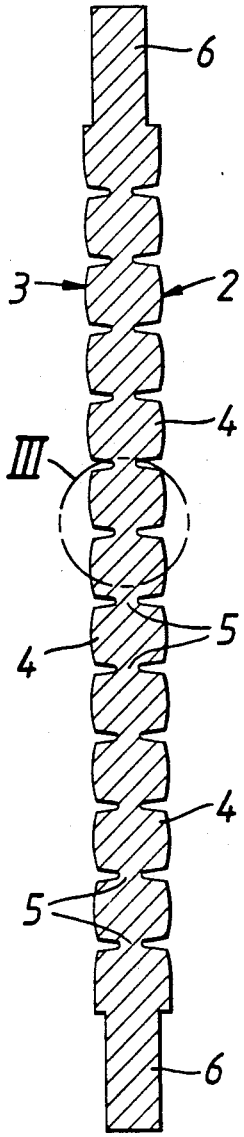
FIG. 2 is a sectional elevation on the line II—II of FIG. 1.

Referring now to the drawings, it will be seen that a rail pad 1 of natural rubber comprises a generally rectangular member in plan, each face 2 and 3 of which is provided with a multiplicity of raised studs 4 extending from a web 5 extending the length and width of the pad and being disposed midway through the thickness thereof. Along each long side of the pad is a rim 6 thicker than the web 5 and having rectangular recesses 7 midway along its length arranged in use positively to locate the pad in its associated rail assembly. It is to be observed that the width and thickness of the rim 6 is intended on each side to provide support and stiffness for the pad to prevent distortion thereof in use.

As can be seen from FIG. 1, alternate studs 8 along each side are of elongate configuration. This additionally aids the desired stiffness and pad support along each side.

It is to be noted that the pad does not have thickened portions along its shorter sides so that water and/or detritus falling onto the pad has a ready and easy exit therefrom.

Figure 3:
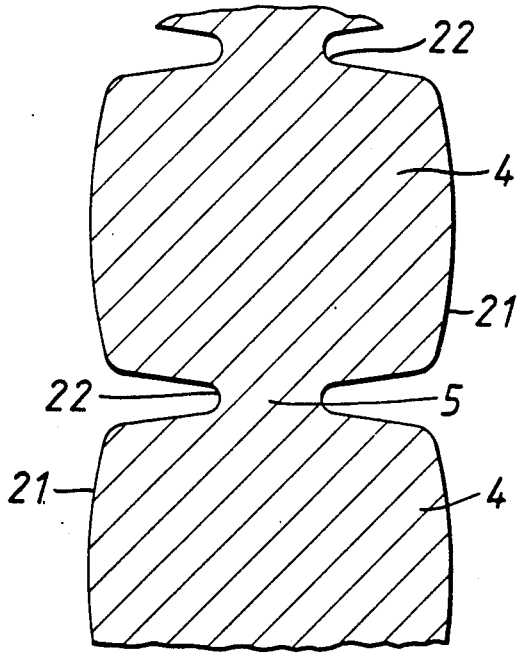
FIG. 3 is an enlarged sectional elevation of the part III of FIG. 2.

Reference to FIG. 3 will show the detailed configuration of the studs 4. Thus each stud is provided with a domed outer surface 21 having a maximum "elevation" over the edge height of the stud of 0.5 mm. The domed surface 21 is intended to ensure adequate contact of all studs with the rail and the foundation member respectively so as to provide full, even support therebetween. Additionally, the junctions 22 between the studs 4 and the central web 5 are continuously curved. Such curved junctions ensure minimum wear during compression and deflection of the studs and pad in use thereof.

The pad has an overall width of 180 mm and a length of 190 mm whilst the portion adapted to underly a rail is 180 mm by 142 mm. The pad, through its studs has a thickness of 11 mm whilst the thickness of the central web is 4 mm. The studs extend to maximum of 3.5 mm from the central web to the dome top and are 10 mm in diameter.

The pad 1 is formed of highly resilient natural rubber (between 55 and 75% rebound value), with high flexural fatigue and between 65 and 75 shore A hardness.

The pad is provided with a total of 187 studs on each face and the surface area of the studs constitutes approximately 58% of each face of the pad over that part of the plan area of the pad intended to lie between the rail and the foundation member.

With such a member of studs and such a proportion of raised surface area, we have found there to be good pad wear characteristics, whilst there is adequate space between the studs for expansion laterally of the studs during their compression in use. We believe that the effectiveness and good dynamic characteristics of the pad as herein defined is significantly related to the provision of adequate space between raised surface portions enabling lateral expansion of them in use.

Figure 4:
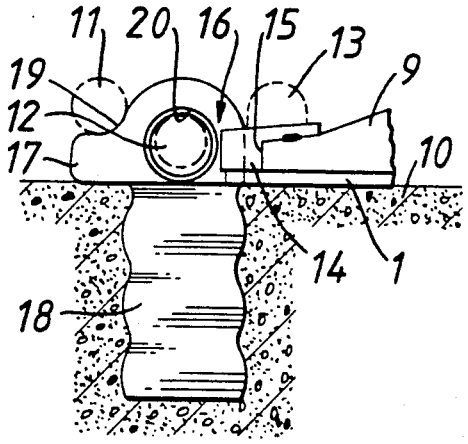
FIG. 4 is a schematic sectional elevation illustrating the incorporation of the pad of FIG. 1 into a rail assembly.

Referring specifically to FIG. 4, it is to be seen that the flange 9 of a flange footed railway rail (not shown) rests on a pad 1 in accordance with the invention which is laid on the upper surface of a concrete rail sleeper 10. On each side of the rail (one side only shown) there is provided an arrangement for holding down the rail on the sleeper, the arrangement including a flexible slip of known kind having three interconnected limbs 11, 12, 13 providing a resilient bearing on relevant portions of the assembly. On the edge of the flange there is placed an electrical insulator 14 which in practice consists of an elongated nylon moulding of approximately L shaped cross-section, one part of which lies on the flange rail and has a limb 13 of the clip bearing upon it, whilst the other part lies against the side 15 of the rail flange.

An anchoring member 16 is fixed to the sleeper consisting of an iron casting having a block portion 17 substantially square in plan on the upper surface of the sleeper 10 and a projecting leg 18 extending downwardly into the sleeper. A concave surface 19 at the top of the block portion 17 receives one further limb 11 of the resilient clip, whilst the third limb 12 of the clip passes through a passage 20 in the block portion. It is to be noted that the block portion locates within the rectangular recess 7 of the pad according to the invention. In operation, the limb 12 of the rail clip passing through the passage 20 of the block 17 presses upwardly, whilst the other two limbs press downwardly thereby holding the assembly together and the rail held securely on the pad 1.

We have found that the pad of the present invention is of most beneficial action when incorporated in a rail assembly of the kind hereinbefore described. Thus, we have found that a pad having a plurality of portions of raised surface having an area compared to the total area of the pad lying between the rail and the sleeper within the range 30–70% is very effective in the "isolation" from the sleeper of impact forces caused by rail traffic transmitted to the pad via the rail, without significant undesirable effects on pad wear, by abrasion, for example.

We have found previously proposed rail pads to be unsatisfactory in providing protection (by attenuation or isolation) for the foundation member of impact forces for rail traffic. Thus, they have been formed of too hard of a material such as high density polyethylene or ethylene vinyl acetate, or have been made too thin (typically at 5 mm) or have been provided with generally flat major surfaces.

In contrast we have found there to be a significant improvement in protection of the foundation member by isolation thereof from impact forces by means of the invention. We have found this to be particularly and remarkably so with a pad having thickness in the preferred range specified above, a configuration as specified above, and formed of material having the preferred characteristics specified above. We believe that this combination of features is particularly important and successful in overcoming the problems of the unsatisfactory performance of the previously proposed rail pads referred to.

Figure 5:
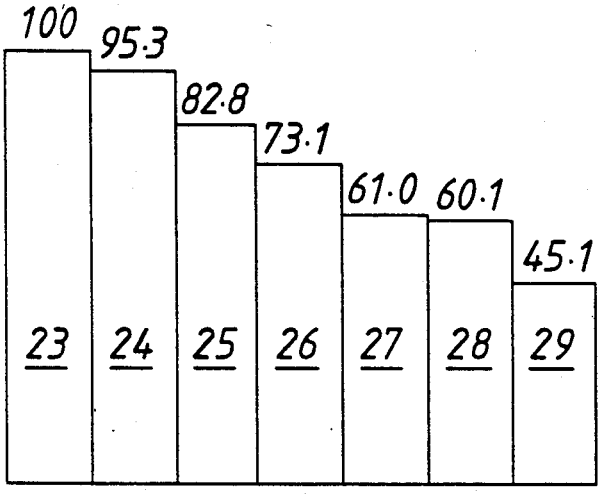
FIG. 5 is of two histograms of results of tests including the pad of FIG. 1.
Figure 5:
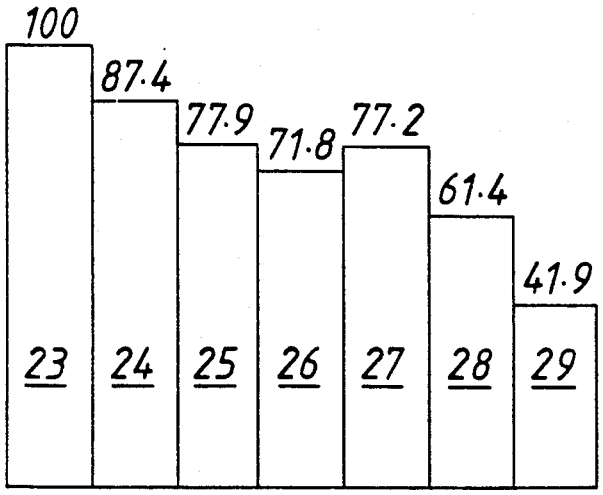

By way of example of the success of the pad of the present invention we refer to FIG. 5 which shows histograms illustrating test results of the effect of various rail pads in reducing high frequency rail sleeper bending strain in concrete sleepers.

Such concrete sleepers can be damaged seriously by impact forces which may occur when, for example, an imperfect train wheel runs on a smooth rail at high speed, or when the rail surface itself is irregular. Of particular importance in this context is the high frequency component of bending strain on the sleeper. FIG. 5 shows the results of rail, pad and sleeper tests to measure this component, the upper histogram showing the aggregate of a multiplicity of results of trains travelling over test rails, pads and sleepers at 50 mph and the lower histogram at 100 mph.

In each case column 23 has been given the value "100" and records the high frequency sleeper bending strain where a standard rail pad moulded from ethylene/vinyl acetate co-polymer having a vinyl acetate content of 12% and of 5 mm thickness was interposed between rail and sleeper. Columns 24, 25, 26, 27 and 28 in each case records the high frequency sleeper bending strains where a typical selection of alternative pads of 10mm thickness and various compositions and configurations were used. Column 29 in each case records the high frequency sleeper bending strain where a pad in accordance with the present invention was interposed between the rail and sleeper.

As can be seen the performance of the pad according to the present invention was, in both cases, considerably better than that of any of the alternative 10 mm thick pads, and in each case resulted in a reduction in measured higher frequency sleeper bending strain of well over 50% in comparison with the use of the above mentioned ethylene/vinyl acetate pad.

By means of the invention, we have provided a rail pad and a rail assembly where the transmission from the rail through to the foundation member of potentially damaging impulsive forces from traffic passing thereacross is greatly reduced, by the isolation of such forces from the foundation member by means of the rail pad of the invention.

We claim:

1. An elastomeric rail pad which reduces high frequency bending strain in a concrete rail sleeper, and having a generally rectangular plan configuration, the pad having an upper face adapted to underlie the lower face of a rail, and a lower face adapted to overlie a rail foundation member, wherein each of the upper and lower faces of the pad is provided with a multiplicity of distinct and separate, stud-like projections, when viewed from adjacent side edges of the rectangular pad, raised above the base level of the respective face and adapted to engage the rail and the foundation member respectively, the stud-like projections opposing each other on opposite faces of the pad; the studs being arranged so that between 40% and 60% of that part of each face which is arranged to lie directly between the rail and the foundation member comprises the stud-like projections; the pad being at least 6 mm in overall thickness, and the stud-like projections being raised above the base level of the faces of the pad by at least 2.00 mm; and the pad being formed of a material having high resilience of between 30% and 90% rebound value, high abrasion resistance, and a hardness of a value between 45 and 95 shore A hardness, whereby the studs can individually compress and deflect thereby minimizing high frequency sleeper bending strains.

2. A rail pad as claimed in claim 1 wherein the pad is between 6.5 and 12 mm in overall thickness.

3. A rail pad according to claim 1 wherein the surface portions are raised above the base level of the faces of the pad by at least 2.5 mm.

4. A rail pad as claimed in claim 1 wherein at least 20 separate raised surface portions are provided for each 100cm$^2$ of that part of each face of the pad which is arranged to lie directly between the rail and the foundation member.

5. A rail pad as claimed in claim 1 wherein opposed sides thereof adapted in use to co-operate with securing members of a rail assembly are provided with rim thicker than the base thickness of the pad so as to provide stiffness at such sides.

6. In a rail pad assembly comprising a rail, a concrete foundation member comprising a concrete rail sleeper, a clip for securing the rail to the foundation member and a pad interposed between the rail and the concrete foundation member and in contact with both, wherein the improvement comprises an elastomeric rail pad which reduces high frequency bending strain in the concrete rail sleeper, and having a generally rectangular plan configuration, the pad having an upper face adapted to underlie the lower face of the rail, and a lower face adapted to overlie the concrete sleeper, wherein each of the upper and lower faces of the pad is provided with a multiplicity of distinct and separate, stud-like projections, when viewed from adjacent side edges of the rectangular pad, raised above the base level of the respective face and adapted to engage the rail and the foundation member respectively, the stud-like projections opposing each other on opposite faces of the pad; the studs being arranged so that between 40% and 60% of that part of each face which is arranged to lie directly between the rail and the foundation member comprises the stud-like projections; the pad being at least 6 mm in overall thickness, and the stud-like projections being raised above the base level of the faces of the pad by at least 2.00 mm; and the pad being formed of a material having high resilience of between 30% and 90 % rebound value, high abrasion resistance, and a hardness of a value between 45 and 95 shore A hardness, whereby the studs can individually compress and deflect thereby minimizing high frequency sleeper bending strains.

7. The rail pad assembly of claim 6, wherein the pad is between 6.5 and 12 mm in overall thickness.

8. The rail pad assembly of claim 6, wherein the surface portions are raised above the base level of the faces of the pad by at least 2.5 mm.

9. The rail pad assembly of claim 6, wherein at least 20 separate raised surface portions are provided for each 100 cm$^2$ of that part of each face of the pad which is arranged to lie directly between the rail and the concrete sleeper.

10. The rail pad assembly of claim 6, wherein opposed sides of the rail pad are adapted in use to co-operate with the securing members of the rail pad assembly, are provided with a rim which is thicker than the base thickness of the pad so as to provide stiffness at such sides.

* * * * *